US006712496B2

(12) United States Patent
Kressin et al.

(10) Patent No.: US 6,712,496 B2
(45) Date of Patent: Mar. 30, 2004

(54) AUGER FED MIXER APPARATUS AND METHOD OF USING

(75) Inventors: Louis Alvin Kressin, Cincinnati, OH (US); Adam Michael Tunis, West Chester, OH (US); James Lewis Davis, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 254 days.

(21) Appl. No.: 09/915,994

(22) Filed: Jul. 26, 2001

(65) Prior Publication Data

US 2003/0090957 A1 May 15, 2003

(51) Int. Cl.[7] ..... B01F 13/06

(52) U.S. Cl. ..... 366/139; 366/164.6; 366/156.1; 366/157.3

(58) Field of Search ..... 366/139, 156.1, 366/164.1, 164.2, 164.6, 156.2, 157.1, 157.2, 157.3, 157.4, 158.2

(56) References Cited

U.S. PATENT DOCUMENTS

| | | | | |
|---|---|---|---|---|
| 3,010,932 A | * | 11/1961 | Stoveken | 366/156.1 |
| 3,502,305 A | * | 3/1970 | Grun | 366/317 |
| 3,580,419 A | | 5/1971 | Carver | |
| 3,669,416 A | * | 6/1972 | Sutter et al. | 366/156.2 |
| 4,185,669 A | | 1/1980 | Jevakohoff | |
| 4,275,033 A | * | 6/1981 | Schulte et al. | 366/158.4 |
| 4,335,964 A | | 6/1982 | Drake et al. | |
| 4,824,032 A | * | 4/1989 | Johansson | 366/157.4 |
| 4,883,363 A | * | 11/1989 | Pillon et al. | 366/157.4 |
| 4,895,274 A | | 1/1990 | Morimoto | |
| 5,184,754 A | | 2/1993 | Hansen | |
| 5,213,414 A | | 5/1993 | Richard et al. | |
| 5,261,743 A | | 11/1993 | Moller | |
| 5,372,423 A | | 12/1994 | Torredeflot | |
| 5,478,147 A | * | 12/1995 | O'Brien et al. | 366/157.4 |
| 5,547,276 A | | 8/1996 | Sulzbach et al. | |
| 5,860,737 A | * | 1/1999 | Hauser | 366/139 |
| 5,913,602 A | | 6/1999 | Steele | |
| 6,021,821 A | | 2/2000 | Wegman | |
| 6,024,141 A | | 2/2000 | Wegman | |
| 6,033,105 A | | 3/2000 | Barker et al. | |
| 6,056,025 A | | 5/2000 | Wegman | |

FOREIGN PATENT DOCUMENTS

| | | |
|---|---|---|
| DE | 196 39 695 A | 3/1997 |
| JP | 62-184831 A | 8/1987 |

* cited by examiner

*Primary Examiner*—Tony G. Soohoo
(74) *Attorney, Agent, or Firm*—Larry L. Huston; Leonard W. Lewis; Steven W. Miller

(57) ABSTRACT

An apparatus and method for dispersing solids into a liquid. The solids may be any particulate material, ranging from cohesive to free flowing. The apparatus and method use an auger to deliver the solids from a hopper to a mixer, where the solids are dispersed into one or more liquids. Typically a vacuum is created in the mixer, or other differential pressures may occur between the hopper and mixer. The apparatus and method provide a delivery rate of the solids which is substantially controlled by the auger rotational speed and substantially independent of the vacuum or other differential pressure at certain auger rotational speeds.

13 Claims, 3 Drawing Sheets

AUGER FED MIXER APPARATUS AND METHOD OF USING

FIELD OF THE INVENTION

This invention relates to apparatus, which handle solids, and more particularly to such apparatus useful for dispersing solids into liquids.

BACKGROUND OF THE INVENTION

Mixers are well known in the art. Mixers have been used to mix solids with other solids and solids with liquids. Solids, as used herein, refers to particulate materials having a median particle size ranging from about 1 micron to about 2 centimeters. Typically solids used with the present invention will have a median particle size ranging from about 20 to 500 microns. Median particle size is measured according to ASTM Standard E1638, incorporated herein by reference. Liquids refers to incompressible materials having no shear modulus. It is to be understood that a mixer may have one or more solids and one or more liquids. The invention described and claimed herein is equally well suited for single and plural solid and/or liquid combinations.

The solids are typically introduced to the mixer through a series of stages in an apparatus. The mixer may be one stage at an intermediate position in or near the end of the apparatus. The first stage of the apparatus is typically a hopper. Solids are introduced to the hopper from a bulk raw material supply. Optionally the hopper may have agitation to assist in transfer of the solids from the hopper. The solids are often transferred through different stages of the apparatus using one or more augers. As used herein an auger is an axially rotatable screw feed. The auger may ultimately feed the solids into a mixer. One or more liquids may be added to the mixer. The mixer has an axially rotatable impeller for dispersing one or more solids throughout the liquid(s). The impeller may create a vacuum in the mixer, as an artifact of the centrifugal mixing process. The solid/liquid dispersion may be drained or pumped from the mixer. The dispersion may be used as a premix for yet another batch or continuous process or may be used as an end product.

It is typically important that the solids be thoroughly and uniformly dispersed throughout the liquid. Properties inherent to the solids may make proper dispersion more difficult to obtain. For example, as particle size decreases and cohesion and the propensity of the solids to hydrate increases, proper dispersion becomes more difficult. Likewise, properties inherent to the liquid may make proper dispersion more difficult to obtain. For example, as viscosity, temperature and backpressure at the mixer outlet increase, proper dispersion becomes more difficult.

Likewise, properties inherent to the apparatus may make proper dispersion of the solids into the liquid more difficult to obtain. For example the vacuum in the mixer may draw solids at an uncontrolled delivery rate. Instead of a constant supply rate, the solids may be supplied to the mixer at a variable supply rate. The variable supply rate may provide more solids at one point in time than can be dispersed by the impeller and less solids at a different point in time. While the impeller imparts a uniform shear rate at any radial position, differences in the amount of solids present may make uniform dispersion more difficult to obtain.

One example of a prior art apparatus is found in U.S. Pat. No. 5,547,276 issued Aug. 20, 1996 to Sulzbach et al. The Sulzbach et al. apparatus transfers solids from a storage vessel to an intermediate tank via a horizontally oriented screw. The solids are transferred from the intermediate tank to a mixing apparatus via a second horizontally oriented screw. Sulzbach et al. also shows a complex arrangement having a vacuum pump and a feedback control device deareates the solids in the intermediate tank. This complex arrangement increases the cost of the Sulzbach et al. apparatus. Furthermore, the horizontally oriented screw increases the apparatus' footprint, increasing the operating cost due to the floor space requirements.

An example of the introduction of particulate material into a receiver is found in U.S. Pat. No. 6,021,821 issued Feb. 8, 2000 to Wegman. Wegman uses a vertically oriented auger to feed fluidized particulate material into a receiver. The receiver has a negative pressure, due to a vacuum assist of up to 10 inches (25.4 cm) of water. Wegman does not teach handling of particulate material under high differential pressure conditions, as often occurs when mixing solids and liquids together. Nor does Wegman teach how to handle materials, such as anthracite coal, or maltodextrin, which become floodable when subjected to fluidization.

The present invention provides an apparatus and method for achieving a controlled delivery rate of solids into a mixer, without the need for a deareating or evacuation step. The present invention also provides an apparatus and method for achieving controlled delivery of solids into a mixer for dispersion throughout one or more liquids or gasses.

SUMMARY OF THE INVENTION

In one embodiment the invention comprises an apparatus for dispersing one or more solids into a liquid. The apparatus comprises a hopper for containing solids. The hopper has a hopper inlet for receiving solids therein and a hopper outlet for distributing solids therefrom. The hopper outlet is in communication with a throat. The throat has a throat inlet for receiving solids from the hopper, a throat outlet for discharging solids from the throat, and an axially rotatable auger disposed in the throat and rotatable at a variable rotational speed. A mixer is in communication with the throat outlet. The mixer has an agitator for mixing together solids and liquids disposed in the mixer. The mixer has a supply line for providing one or more liquids to the mixer. Axial rotation of the auger supplies a quantity of solids to the mixer. The solids are supplied to the mixer at a determinable delivery rate, which is proportional to the rotational speed of the auger over a range of auger rotational speeds.

DETAILED DESCRIPTION OF THE INVENTION

Figure 1:
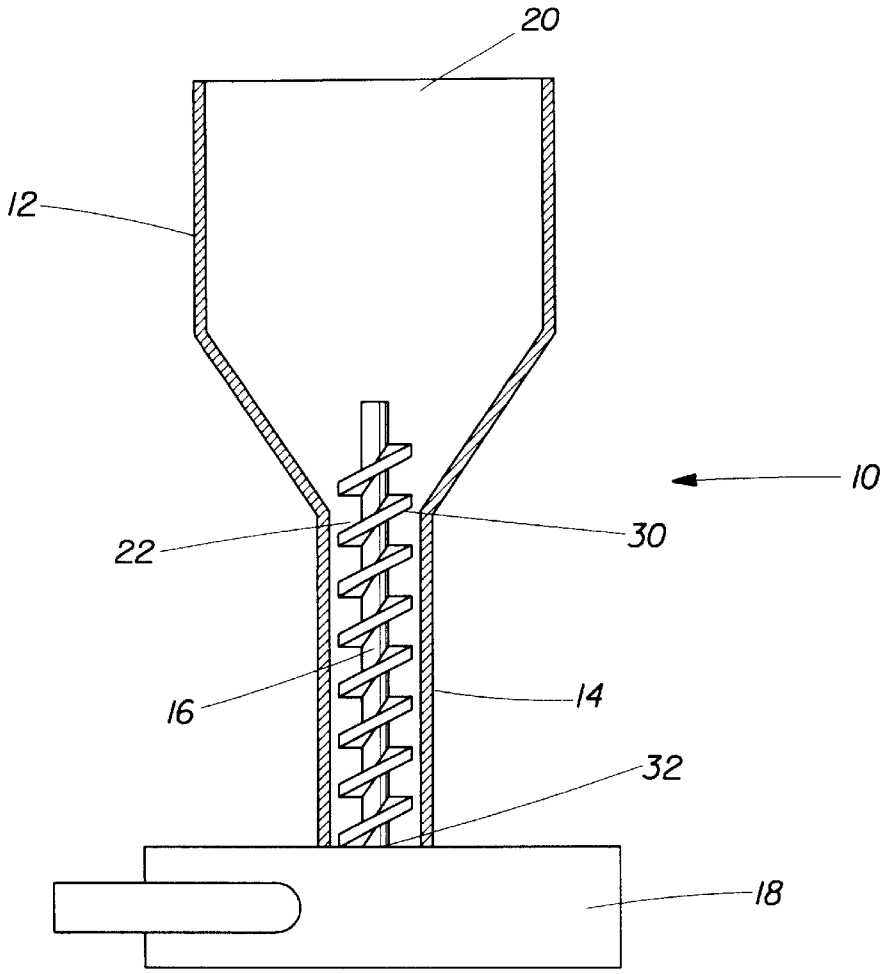
FIG. 1 is a schematic view of an apparatus according to the present invention and having a vertically oriented auger.

Referring to FIG. 1, the apparatus 10 comprises a hopper 12. Solids are placed in the hopper 12. The hopper 12 has a throat 14 for discharging or otherwise distributing the solids therefrom. An auger 16 is disposed in the throat 14 of the hopper 12. The throat 14 has an outlet in communication with a mixer 18. At least one supply line provides one or more liquids to the mixer 18.

The apparatus 10 provides for controlled distribution of the solids from the hopper 12 to the mixer 18. By controlled distribution it is meant that the delivery rate of the solids into the mixer 18 is controlled within plus or minus 10 percent, and preferably plus minus 5 percent of a desired delivery rate by the operation of the auger 16 at various rotational speeds by simply adjusting the auger rotational speed. The controlled distribution, within the aforementioned limits, is independent of the pressure in either the hopper 12 or mixer 18.

Examining the components in more detail, the hopper 12 may be any container suitable for receiving solids therein. The capacity of the hopper 12 is suitable for the intended purpose of controlled batch distribution of solids into the mixer 18. The hopper 12 has a hopper inlet 20 for receiving the solids therein. The hopper inlet 20 is typically disposed near the top of the hopper 12. The solids may be manually added to the hopper 12 or added by other mechanical means. The hopper 12 further has a hopper outlet 22 for discharging the solids from the hopper 12. The hopper outlet 22 is typically located at or near the bottom of the hopper 12.

The hopper 12 may be pressurized, to facilitate transfer of solids therefrom. Alternatively, the hopper 12 may be subjected to a subatmospheric pressure as described below to deareate the solids. Either condition will create a differential pressure across the throat 14 of the apparatus 10, except in the degenerate case where an identical pressure exists in the mixer 18.

The hopper 12 may have a lid, or other closure, to reduce dust which may occur during dispensing of solids into or from the hopper 12. Optionally, the hopper 12 may have an impeller, air jets, or other form of mechanical agitation to reduce occurrences of irregular or inconsistent feeding of the solids from the hopper 12. Optionally, the hopper 12 may have a deareating system, although the complexity of such a system is not necessary with the claimed invention.

A suitable hopper 12 may be a funnel hopper 12, which converges in cross section as the hopper outlet 22 is approached. A control valve may be juxtaposed with the throat outlet 32. The control valve may be used for throttling or more typically for on-off control. The control valve may be manually operated or operated by a control scheme, as set forth below. A butterfly valve is often used for the control valve.

If a control scheme is selected to guide operation of the control valve, the control scheme may open the valve on demand, admitting solids to the mixer 18 of the apparatus 10. The valve may open in response to sensing the addition of a new batch of solids in the hopper 12, on a timer, or manual input from an operator. The timing and rate of opening of the control valve may both be guided by the control scheme.

The control scheme may also guide the timing and closing rate of the control valve. For example, the control valve may be closed when the control scheme senses the hopper 12 is empty or nearly so, or when a predetermined amount of solids has entered the mixer 18, based upon auger 16 rotations, gross weight of the mixer 18 or a timer. If desired, a feedback loop may be incorporated into the control scheme to operate the control valve in response to conditions in the hopper 12 and/or mixer 18. The control scheme may also control the speed of the auger rotation, providing throttling capability.

The hopper outlet 22 is connected to and in communication with a throat inlet 30. Solids enter the throat 14 through the throat inlet 30 and exit the throat 14 through a throat outlet 32. The throat inlet 30 and throat outlet 32 define an axis therebetween and are axially opposed with respect to that axis.

In the embodiment of FIG. 1, the throat 14 may be vertically oriented. As used herein, vertically oriented refers to configurations where the axis is coincident true vertical or within plus or minus 15 degrees in a first embodiment and plus or minus 10 degrees of true vertical in a second embodiment. The throat 14 may be of any suitable cross section which seal the auger 16, with a round cross section having been found most commonly used. The throat 14 may be of constant or variable cross section.

In an alternative embodiment (not shown) the auger 16 may be horizontally oriented or oriented at a position intermediate the horizontal and vertical. All such orientations in this alternative embodiment are referred to as non-vertical orientations.

An axially rotatable auger 16 is disposed in the throat 14. The auger 16 is vertically oriented and coincident the true vertical in the embodiment of FIG. 1. As used herein an auger 16 refers to a screw feed mechanism having one or more flights spiral wound about a central longitudinal axis in an involute fashion. The auger 16 has a proximal end juxtaposed with the hopper 12 and a distal end juxtaposed with the mixer 18. The longitudinal axis of the auger 16 extends from the proximal end to the distal end of the auger 16. The proximal end of the auger 16 may be disposed in the hopper 12, further allowing the auger 16 to transport solids from the hopper 12 into the throat 14 and ultimately to the mixer 18 without starvation.

The flight of the auger 16 may be of constant diameter throughout its length, to form a free-flow auger 16. In an alternative embodiment the portion of the flight disposed inside the hopper 12 may be of greater diameter than the portion of the flight disposed inside the throat 14, to form a non-freeflow auger 16. If, this alternative embodiment is selected, care should be taken that it does not lead to plugging of the solids in the throat 14. Plugging may occur if the larger diameter flights in the hopper 12 feeds a greater quantity of solids than can be discharged through the throat 14.

Furthermore, augers 16 having constant and variable flight diameters in the throat 14, constant and variable root diameters, and constant and variable flight pitches are contemplated. Furthermore, multiple flights may be utilized, as well as flights which are continuous, discretely segmented and combinations thereof.

In the prior art, the delivery rate of the solids from hopper 12 is controlled by the vacuum created in the mixer 18, any other differential pressure which may be present in the system, or the throttle valve (if any). In the present invention, the delivery rate of the solids from the throat outlet 32 may be controlled by the auger 16 rotational speed or by a combination of auger rotational speed and differential pressure. Auger 16 control of the solids delivery rate may be accomplished by sealing the throat 14 against excessive airflow therethrough. Of course, if a blanket of inert gas, or a compressible fluid other than air is used with the present invention, the sealing should prevent excessive flow of any such gas through the throat as well.

In order for a solids delivery rate controlled by auger 16 rotational speed to occur the auger 16 may seal the throat 14 against the differential pressure. To seal the throat, the auger 16 must have sufficient length, the annular clearance between the auger 16 and throat 14 must be minimal and the flight of the auger 16 preferably subtend at least 540 degrees. Generally, as the solids becomes more free flowing, the flight will have to subtend a greater number of revolutions to accomplish sealing. Auger 16/throat 14 combinations which accomplish sealing in accordance with the present invention are called out in the illustrative examples below.

In order for a solids delivery rate controlled by auger 16 rotational speed to occur the auger 16 may seal the throat 14 against the differential pressure. To seal the throat, the auger 16 must have sufficient length, the annular clearance between the auger 16 and throat 14 must be minimal and the flight of the auger 16 preferably subtend at least 540 degrees. Generally, as the solids becomes more free flowing, the flight will have to subtend a greater number of revolutions to accomplish sealing. Auger 16/throat 14 combinations which accomplish sealing in accordance with the present invention are called out in the illustrative examples below.

Directionally, greater sealing will occur as 1) the pitch of the auger 16 decreases since, the flights are more perpendicular to the direction of applied differential pressure, 2) multiple flights are used on the auger 16, since more flights in the auger 16 reduces the void space in the throat 14, 3) the auger 16/throat 14 length increase, since there are more stages to reduce the effects of the differential pressure, 4) the throat 14 diameter decreases, since this reduces void space and total area over which the differential pressure can act, and 5) the hopper 12 is filled with a greater quantity of solids, as this will minimize entry of ambient air at the proximal end of the auger 16.

Optionally, a drip washer may be added to the auger 16 to further increase sealing. Typically the drip washer is disposed on and attached to the distal end of the auger 16. The drip washer may be rotatably attached to the auger 16, or may rotate with the auger 16. A drip washer is a plate, typically round, which occludes the throat 14, and thereby promotes sealing. A round drip washer, utilized with a round throat 14 may have a diameter approximately one-half the diameter of the throat 14. A larger or smaller diameter optional drip washer may be utilized, to provide more or less sealing of the throat 14, respectively.

For free-flowing powders another device that may increase sealing is a small lip disposed in the throat 14, and preferably juxtaposed with the throat outlet 32. The lip is an annular ring which intrudes into the throat 14, decreasing the diameter of the throat outlet 32. The inner diameter of the lip may be slightly larger than the diameter of the auger 16 and smaller than the diameter of the throat 14.

Additionally, selection of the solids may influence the sealing of the throat 14. Solids vary in cohesiveness, flowability, packing density, and other farinaceous characteristics. As the packing density of the solids increases, less air entrained in the solids will be transmitted through the throat 14. Less air entrainment will allow greater sealing to occur.

The auger 16 may rotate about its axis at a rate dependent upon the diameter of the auger 16, the number and pitch of the flights, and desired flow rate of the solids. The direction of axial rotation will be that which propels the solids from the hopper 12 towards the mixer 18. While a single hopper 12/throat 14/auger 16 combination feeding the mixer 18 is illustrated, embodiments having two or more hopper 12/auger 16/throat 14 combinations feeding a single mixer 18 are also contemplated. If solids from multiple hopper 12s feed a single mixer 18, the hoppers 12 may contain the same or different solids.

While a hopper 12 disposed vertically above the mixer 18 is illustrated in FIG. 1, an embodiment where the hopper 12 is disposed vertically below the mixer 18 is also contemplated. If an embodiment having the mixer 18 disposed vertically above the hopper 12 is selected, care should be taken that liquid in the mixer 18 does not prematurely wet the solids in the throat 14, although premature wetting is a consideration in any embodiment of the present invention.

The throat 14 expels or otherwise discharges the solids into a mixer 18. The mixer 18 is typically sealed to maintain the aforementioned differential pressure, but may be open to the atmosphere if the hopper 12 has a subatmoshpheric pressure therein. In an exemplary embodiment the mixer 18 is sealed to prevent contamination and spilling of contents.

At least one supply line is provided to the mixer 18. Each supply line provides a liquid to the mixer 18. The liquid in each supply line may comprise a single component, multiple components, one or more gasses, or a mixture of liquids and solids.

An agitator is provided in the mixer 18. The agitator is commonly an axially rotatable impeller. Additionally, a shaker which cyclically disturbs the entire mixer 18, magnetic stir bars or other means known in the art may be used as the agitator. A rotatable impeller may have either a vertical or horizontal shaft impeller.

Upon agitation a vacuum may be created in the mixer 18. In the most common embodiment, the vacuum occurs due to the centrifugal effect of the impeller throwing the contents of the mixer 18 outwardly. The centrifugal action creates a void in the center of the mixer 18. The void creates a low pressure zone, i.e. vacuum. The vacuum will cause a differential pressure across the throat 14, except for the degenerate case where an identical pressure is maintained in the hopper 12. Prophetically a positive pressure may be maintained in the mixer 18. A positive pressure will occur if the mass flow rate of liquid from the one or more supply lines exceeds the mass flow rate being discharged from the mixer 18. Again, a positive pressure in the mixer 18 will cause a differential pressure across the throat 14, except for the degenerate case where an identical pressure is maintained in the hopper 12.

Using the present invention, solids and liquids may be added to the apparatus 10 in a continuous process, unlike the batch processes found in the prior art. The continuous process is made possible by the controlled and predeterminable solids delivery rate occurring at certain auger 16 rotational speeds. Further, since the solids delivery rate can be determined by the positive delivery provided by the auger 16 control, a greater quantity of solids can prophetically be delivered with the invention than according to the prior art. This allows a mixture with a higher solids concentration to be produced. Likewise, the present invention allows higher viscosity liquids to be used in the mixer 18. For example, liquids with viscosities as high as 50,000 or 75,000 centipoises may be used in the mixer 18 with the present invention. The prior art apparatus 10 were generally unable to use high viscosity liquids, due to the difficulty of stirring with an impeller. The high viscosity liquids generally do not create a vortex, and thus do not cause a subatmospheric pressure to be formed in the mixer 18. However, the present invention neither needs nor relies upon a subatmospheric pressure to supply solids to the mixer 18 at certain controlled delivery rates.

In an alternative embodiment the apparatus 10 of the present invention may be used to disperse solids into a gas. This may be particularly useful in, for example, pneumatic conveying. This apparatus 10 provides the advantage that controlled metering of the solids into a pressurized gas flow may be readily accomplished.

The apparatus 10 and method according to the present invention operate in three different regimes, dependent upon auger rotational speed: a substantially vacuum controlled regime, a regime substantially controlled by a combination of the vacuum and auger rotational speed, and a regime controlled by the auger rotational speed. In operation it is believed that at relatively slower auger 16 rotational speeds the solids delivery rate is controlled by the differential pressure across the throat 14 in which the auger 16 is disposed. Particularly, the solids delivery rate is controlled by the vacuum in the mixer 18. This effect can be graphically displayed by noting that as auger 16 rotational speed increases over a range, the solids delivery rate remains relatively constant over the same range. As the auger 16 rotational speed increases, a transition region occurs. In the transition region the solids delivery rate is controlled by the superposition of the auger 16 rotational speed and the mixer 18 vacuum or other differential pressure. As the auger 16 rotational speed increases further, the solids delivery rate is substantially controlled by the auger 16 rotational speed. This may be graphically illustrated by the linear increase in solids delivery rate over that same range of auger 16 rotational speeds.

To determine which phenomenon is controlling the solids delivery rate, i.e. in which of the three regimes the apparatus 10 is operating, the following approach may be used. At any particular auger 16 rotational speed the actual solids delivery rate is compared to the theoretical solids delivery rate. If the actual solids delivery rate is greater than the theoretical solids delivery rate, the apparatus is operating in the vacuum controlled regime or the combination vacuum and auger rotational speed controlled regime. To determine in which of these two regimes the apparatus is operating, the slope of the graph, as illustrated in FIGS. 2–5, is examined. If the slope is negligible between any two auger rotational speeds, the vacuum is controlling the solids delivery rate. Conversely, if the slope is positive, the combination of vacuum and auger rotational speed is controlling the solids delivery rate. If the actual solids delivery rate is less than the theoretical solids delivery rate, then the auger rotational speed is controlling the solids delivery rate. One of skill will understand that a positive pressure in the mixer 18 or a positive/subatmospheric pressure in the hopper 12 may be present and the foregoing analysis adjusted accordingly.

For Examples 1–2, auger 16 rotational speed was measured with a tachometer. For Examples 3–4 auger 16 rotational speed was measured directly from the drive to the auger 16.

The various facets of the invention and the different regimes of vacuum control, vacuum/auger 16 rotational speed control and auger 16 rotational speed control of the solids delivery rate are collectively illustrated by the following nonlimiting, illustrative examples.

EXAMPLE 1

A pilot scale Mateer-Burt 1900 auger 16 filler was provided. A funnel hopper 12 and model 7510-130 F1114 LMP Tri-blender mixer 18 were provided. A vertically oriented no. 20 free flow auger 16 having a diameter of 3.18 cm. (1.25 inch) and a single flight with a pitch of 3.8 cm (1.5 inch) was also provided and disposed as illustrated in FIG. 1. The auger 16 had a length of 15.2 cm (6 inches). The auger 16 was disposed such that 10.2 cm (4 inches) of its length was disposed in the throat 14 and 5.1 cm (2 inches) extended into the hopper 12. A 3.2 mm (⅛ inch) radial clearance was provided between auger 16 and the throat 14. The auger 16 was run without a drip washer.

The hopper 12 was filled with solids comprising Polyox Peg-7M, CAS no. 25322-68-3. For the test runs, water was added to the mixer at a rate of approximately 40 kg/min.

The mixer 18 was agitated with a vertical impeller, capable of rotating at 3600 rpm, and creating a vacuum of 700 mm Hg. The mixer 18 was run without operation of the impeller, and thus without vacuum, for the control and with rotation of the impeller during testing. The results for the control (no mixer 18 vacuum) and test runs (with mixer 18 vacuum) are tabulated in Tables 1–2 respectively.

TABLE 1

| Vacuum | Solids | Auger RPM | Powder Solids Delivery Rate (kg/min) | Slope (kg*rpm/min) |
|---|---|---|---|---|
| None | Polyox | 0 | 0.3 | — |
| None | Polyox | 47 | 0.6 | 0.006 |
| None | Polyox | 132 | 1.1 | 0.006 |
| None | Polyox | 227 | 1.8 | 0.007 |

Table .1 illustrates that even with the auger 16 off (0 RPM) the solids slowly fed out of the hopper 12. Eventually the throat 14 became clogged, stopping the solids flow. Table 1 also illustrates that solids delivery rate is controllable by auger 16 rotational speed, over the range from 47 to 227 rpm when a differential pressure is not present across the auger 16.

Next the mixer 18 impeller was activated and the test repeated with a vacuum in the mixer 18. The results are tabulated in Table 2.

TABLE 2

| Vacuum | Solids | Auger RPM | Powder Solids Delivery Rate (kg/min) | Slope (kg*rpm/min) |
|---|---|---|---|---|
| Yes | Polyox | 0 | 0.86 | — |
| Yes | Polyox | 0 | 2.2 | — |
| Yes | Polyox | 0 | 0.7 | — |
| Yes | Polyox | 0 | 0.8 | — |
| Yes | Polyox | 47 | 2.1 | 0.028 |
| Yes | Polyox | 100 | 2.3 | 0.004 |
| Yes | Polyox | 132 | 2.4 | 0.003 |

Note, the 2.2 kg/min datum point is likely an outlier and was not further considered. The slope from 0 to 47 rpm was determined using an average of the other three solids delivery rates at 0 rpm. Table 2 illustrates that solids delivery rate is independent of auger 16 speed, and thus is substantially controlled by the mixer 18 vacuum.

The common data in Tables 1 and 2 are combined to show the difference in solids delivery rate attributable to the vacuum occurring in the mixer 18. The percentage differences in solids delivery rates and slope are tabulated in Tables 3 and 4 below, respectively.

TABLE 3

| Auger Speed (RPM) | Control Polyox Solids Delivery Rate (kg/min) | Test Polyox Solids Delivery Rate (kg/min) | Percent Difference In Solids Delivery Rates |
|---|---|---|---|
| 47 | 0.6 | 2.1 | 250 |
| 132 | 1.1 | 2.4 | 118 |

TABLE 4

| Auger Speed (RPM) | Control Polyox Slope (kg*rpm/min) | Test Polyox Slope (kg*rpm/min) | Percent Difference In Slopes |
|---|---|---|---|
| 47<br>132 | 0.006 | 0.004 | 33 |

EXAMPLE 2

A pilot scale Mateer-Burt 1900 auger 16 filler was provided. A funnel hopper 12 having a 40 rpm internal agitator arm and a model 7510-130 F1114 LMP Tri-blender mixer 18 were provided. A vertically oriented no. 16 free flow auger 16 having a constant diameter of 2.54 cm. (1 inch) and a single flight with a pitch of 1.3 cm (0.5 inch) was also provided and disposed as illustrated in FIG. 1. The auger 16 had a length of 35.6 cm (14 inches). The auger 16 was disposed such that 30.5 cm (12 inches) of its length was disposed in the throat 14 and 5.1 cm (2 inches) extended into the hopper 12. A 3.2 mm (⅛ inch) radial clearance was provided between the auger 16 and the throat 14. The auger 16 was run without a drip washer.

The mixer 18 was agitated with a vertical impeller, capable of rotating at 3600 rpm, and creating a vacuum of 700 mm Hg. The mixer 18 was run without operation of the impeller, and thus without vacuum, for the control and with rotation of the impeller during testing. Likewise, the hopper 12 internal agitator was used at 40 rpm.

The hopper 12 was filled with polyquaternium-10 LR 400 CAS no. 53568-66-4, Mainline LR 400 solids. Ammonium Laureth Sulfate surfactant, CAS no. 32612-48-9 at a temperature of 63–77 degrees C was added to the mixer 18 at a rate of approximately 40 kg/min. for the test runs.

The results for the control (no mixer 18 vacuum) and test runs (with mixer 18 vacuum) are tabulated in Tables 5–6 respectively.

TABLE 5

| Vacuum | Solids | Agitator Arm | Auger Speed (RPM) | Mainline LR 400 Solids Delivery Rate (kg/min) | Slope (kg/rpm/min) |
|---|---|---|---|---|---|
| None | Mainline LR 400 | 40 rpm | 251 | 0.48 | — |
| None | Mainline LR 400 | 40 rpm | 379 | 0.71 | 0.002 |
| Nore | Mainline LR 400 | 40 rpm | 509 | 1.01 | 0.002 |

Figure 2:
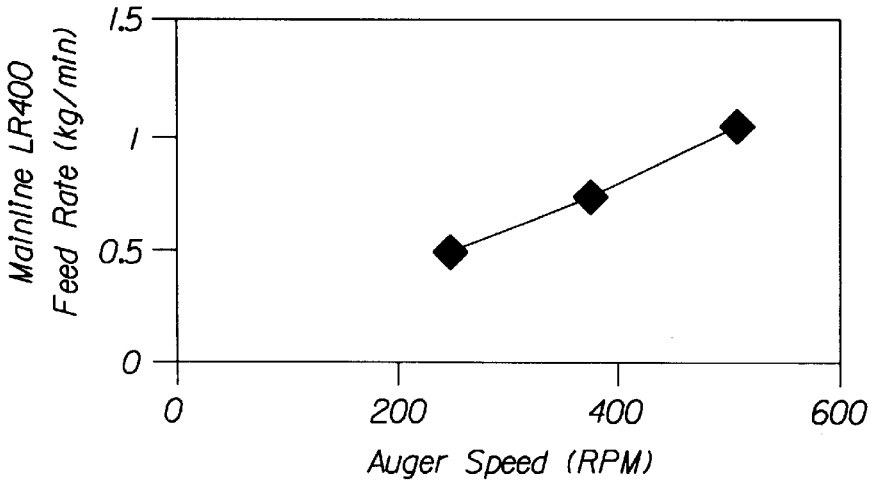
FIGS. 2–5 are graphical representations of exemplary solids delivery rates for various auger rotational speeds.
Figure 3:
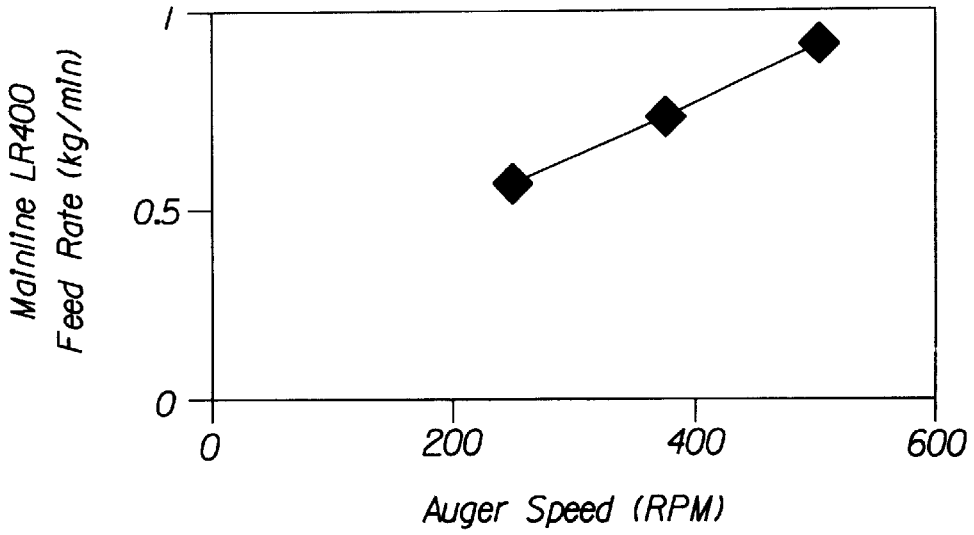

The data from Table 5 are graphically illustrated in FIG. 2. FIG. 2 illustrates that the auger 16 speed was controlling the solids delivery rate for the control Next, the mixer 18 impeller was activated and the test repeated. The results are shown in Table 6 below and graphically illustrated in FIG. 3. FIG. 3 shows that auger 16 speed is controlling the solids delivery rate.

TABLE 6

| Vacuum | Solids | Agitator Arm | Auger Speed (RPM) | Mainline LR 400 Solids Delivery Rate (kg/min) | Slope |
|---|---|---|---|---|---|
| Yes | Mainline LR 400 | 40 rpm | 251 | 0.53 | — |

TABLE 6-continued

| Vacuum | Solids | Agitator Arm | Auger Speed (RPM) | Mainline LR 400 Solids Delivery Rate (kg/min) | Slope |
|---|---|---|---|---|---|
| Yes | Mainline LR 400 | 40 rpm | 251 | 0.55 | |
| Yes | Mainline LR 400 | 40 rpm | 379 | 0.71 | 0.001 |
| Yes | Mainline LR 400 | 40 rpm | 509 | 0.92 | 0.002 |
| Yes | Mainline LR 400 | 40 rpm | 509 | 0.98 | |

The data in Tables 5 and 6 are combined to show the difference in solids delivery rate attributable to the vacuum occurring in the mixer 18. The solids delivery rates at 251 and 509 rpm in Table 6 were averaged for purposes of comparison with the delivery rates in Table 5. The percentage differences in solids delivery rate and slope are tabulated in Tables 7–8, respectively.

TABLE 7

| Auger Speed (RPM) | Control Mainline LR 400 Solids Delivery Rate (kg/min) | Test Mainline LR 400 Solids Delivery Rate (kg/min) | Percent Difference In Solids Delivery Rates |
|---|---|---|---|
| 251 | 0.48 | 0.54 | 12.5 |
| 379 | 0.71 | 0.71 | 0 |
| 509 | 1.01 | 0.95 | 5.9 |

TABLE 8

| Auger Speed (RPM) | Control Mainline LR 400 Slope (kg*rpm/min) | Test Mainline LR 400 Slope (kg*rpm/min) | Percent Difference In Slopes |
|---|---|---|---|
| 251 | — | — | — |
| 379 | 0.002 | 0.001 | 50 |
| 509 | 0.002 | 0.002 | 0 |

EXAMPLE 3

A Tri-clover, Inc. model F2116MD triblender was used to mix the liquid and solids. A 56 cm (22 inch) diameter model A-100 auger 16 feeder system made by AMS Filling Systems, Inc. was used to contain and dispense the solids to the mixer 18. The hopper 12 was filled with maltodextrin M-180, CAS No. 9050-36-6. Water at room temperature was added at a rate of 110–120 kg/min for the test runs.

A vertically oriented number 20 free flow funnel and free flow auger 16 having a diameter of 3.18 cm. (1.25 inch) and a single flight with a pitch of 3.8 cm (1.5 inch) was also provided and disposed as illustrated in FIG. 1. The results for the control (no mixer 18 vacuum) and test runs (with mixer 18 vacuum) are tabulated in Tables 9–10, respectively. The data from the control (no vacuum) and test runs (with vacuum) are shown in Table 9 and graphically illustrated in FIG. 4.

For this example, the theoretical volume per flight within the auger 16 was taken from the GE: Mateer Auger Data Guide, copyrt. 1991 and incorporated herein by reference. For the examples where a non-standard auger 16 was used, the theoretical volume per flight within the auger 16 was calculated using a water displacement method.

The theoretical volume was used to calculate a theoretical delivery rate. This was compared to the actual delivery rate with the vacuum from the mixer 18 present. If this actual delivery rate exceeded the theoretical delivery rate, the apparatus 10 was judged to be delivering solids at a delivery rate controlled by the vacuum or by a combo of a vacuum and auger 16 rotational speed. If the actual delivery rate was less than the theoretical delivery rate, the apparatus 10 was judged to be delivering solids at a delivery rate controlled by the rotational speed of the auger 16.

TABLE 9

| Auger Rotational Speed (RPM) | Theoretical Auger Volume per Revolution (Kg) | Control Solids Delivery Rate (without vacuum) (Kg/min) Calculated Delivery Rate | Actual Delivery Rate | Percent Difference | Test Solids Delivery Rate (with vacuum) (Kg/min) Actual Delivery Rate | Percent difference vs. calculated delivery rate |
|---|---|---|---|---|---|---|
| 50 | 1.59 | 0.88 | 0.61 | 70% | 3.41 | 390% |
| 100 | 3.18 | 1.75 | 1.24 | 71% | 3.45 | 197% |
| 150 | 4.77 | 2.62 | 1.80 | 69% | 5.20 | 198% |
| 200 | 6.36 | 3.50 | 2.40 | 68% | 6.03 | 172% |
| 300 | 9.54 | 5.247 | 3.55 | 68% | 7.30 | 139% |
| 400 | 12.72 | 6.99 | 4.80 | 69% | 8.62 | 123% |
| 500 | 15.90 | 8.75 | 6.31 | 72% | | |
| 600 | 19.08 | 10.49 | 7.57 | 72% | 9.54 | 91% |

Figure 4:
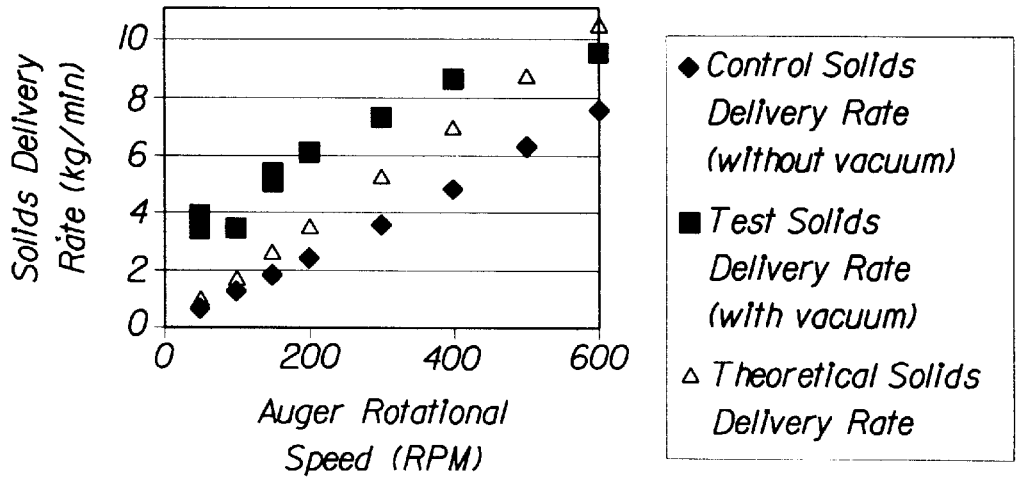
Figure 5:
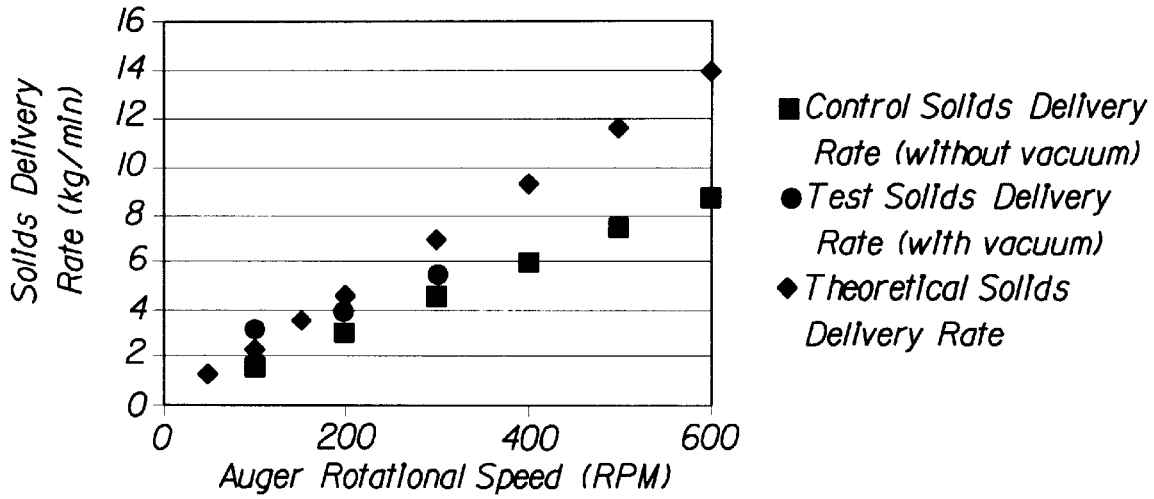

Table 9 shows that the actual solids delivery rate with vacuum exceeds the theoretical solids delivery rate for auger 16 rotational speeds of 0 to 400 rpm. Therefore, the vacuum in the mixer 18 is either controlling or making a contribution to the solids delivery rate. Referring to FIG. 4, the negligible slope from 0 to 100 rpm illustrates the solids delivery rate is controlled by the vacuum over this range of auger 16 rotational speeds. FIG. 4 also illustrates that from 100 to 400 rpm the solids delivery rate is controlled by a combination of the vacuum and the auger 16 rotational speed. At auger 16 rotational speeds of 600 rpm and greater, the solids delivery rate is controlled by the auger 16 rotational speed.

EXAMPLE 4

The apparatus 10 and conditions of Example 3 were used for Example 4, except as follows. The hopper 12 was filled with Citric Acid, CAS No. 77-92-9. A number 28 free flow auger 16 having a 4.45 cm (1.75 inch) diameter and free flow funnel were used. The auger 16 had a 3.8 cm (1.5 inch) pitch. The control and test data are shown in Table 10.

TABLE 10

| Auger Rotational Speed (RPM) | Theoretical Auger Volume per Revolution (g) | Control Solids Delivery Rate (without vacuum) (g/min) Calculated Delivery Rate | Actual Delivery Rate | Percent Difference | Test Solids Delivery Rate (with vacuum) (g/min) Actual Delivery Rate | Percent difference vs. calculated delivery rate |
|---|---|---|---|---|---|---|
| 50 | 3315.0 | 2983.5 | | | | |
| 100 | 6630.0 | 5967.0 | 4225 | 71% | 4040 | 68% |
| 150 | 9945.0 | 8950.5 | | | 6100 | 68% |
| 200 | 13260.0 | 11934.0 | 8559 | 72% | 7860 | 66% |
| 300 | 19890.0 | 17901.0 | 12076 | 67% | | |
| 400 | 26520.0 | 23868.0 | 15788 | 66% | | |
| 500 | 33150.0 | 29835.0 | 19406 | 65% | | |
| 600 | 39780.0 | 35802.0 | 22517 | 63% | | |

Table 10 illustrates that for auger rotational speed of 100–200 rpm the actual solids delivery rate is less than the theoretical solids delivery rate. Accordingly, the auger 16 rotational speed is controlling the solids delivery rate for this range of auger 16 rotational speeds. Since the actual solids delivery rate was less than the theoretical solids delivery rate at the slower auger 16 rotational speeds, it was deemed unnecessary to run the test at higher auger 16 rotational speeds.

EXAMPLE 5

The apparatus 10 and conditions of Example 3 were used for Example 5, except as follows. The hopper 12 was again filled with maltodextrin M-180, CAS No. 9050-36-6. A number 28 free flow auger 16 having a diameter of 4.45 cm (1.75 inches) free flow funnel were used. The auger 16 had a 2.5 cm (1 inch) pitch. The control test data are shown in Table 11 and graphically illustrated in FIG. 5.

TABLE 11

| Auger Rotational Speed (RPM) | Theoretical Auger Volume per Revolution (g) | Control Solids Delivery Rate (without vacuum) (g/min) Calculated Delivery Rate | Actual Delivery Rate | Percent Difference | Test Solids Delivery Rate (with vacuum) (g/min) Actual Delivery Rate | Percent difference vs. calculated delivery rate |
|---|---|---|---|---|---|---|
| 50 | 2110.0 | 1160.5 | | | | |
| 100 | 4220.0 | 2321.0 | 1500 | 65% | 2780 | 120% |
| 150 | 6330.0 | 3481.5 | | | | |
| 200 | 8440.0 | 4642.0 | 3023 | 65% | 4140 | 89% |
| 300 | 12660.0 | 6963.0 | 4504 | 65% | 5400 | 78% |
| 400 | 16880.0 | 9284.0 | 5927 | 64% | | |
| 500 | 21100.0 | 11605.0 | 7376 | 64% | | |
| 600 | 25320.0 | 13926.0 | 8742 | 63% | | |

Table 11 illustrates that at 100 rpm the mixer 18 vacuum is either controlling or contributing to the solids delivery rate. Without examining the slope of the line corresponding to the solids delivery rate vs auger 16 rotational speed, it is difficult to determine under which of these two regimes the apparatus 10 is operating. Table 11 also shows that at 200–300 rpm the actual solids delivery rate is less than the theoretical solids delivery rate. Thus, at this range of auger 16 rotational speeds the auger 16 rotational speed controls the solids delivery rate.

What is claimed is:

1. An apparatus for dispersing one or more solids into a liquid, said apparatus comprising:

a hopper for containing said solids, said hopper having a hopper inlet for receiving solids therein and a hopper outlet for distributing solids therefrom, said hopper having a first pressure therein relative to atmospheric pressure, said hopper outlet being in communication with a throat having a throat inlet for receiving solids from said hopper, a throat outlet for discharging solids from said throat, a vertically oriented axially rotatable auger disposed in said throat and rotatable at a variable rotational speed, a mixer in communication with said throat outlet, said mixer having an agitator for mixing together solids and liquids disposed in said mixer, said mixer having a second pressure therein relative to atmospheric pressure, said pressure in said mixer being different than said pressure in said hopper, a supply line for providing one or more liquids to said mixer, whereby axial rotation of said auger supplies a quantity of solids to said mixer, said solids being supplied to said mixer at a delivery rate proportional to said rotational speed of said auger over a range of auger rotational speeds, wherein said auger supplies solids at a first delivery rate with no differential pressure across said throat and a second delivery rate with a differential pressure across said throat, said second delivery rate being within 10 percent of said first delivery rate.

2. An apparatus according to claim 1 wherein said mixer has a subatmospheric pressure therein.

3. An apparatus according to claim 2 wherein said agitator comprises a rotatable impeller disposed in said mixer, whereby rotation of said impeller causes said subatmospheric pressure in said mixer.

4. An apparatus according to claim 1 wherein said hopper has a positive pressure therein relative to atmospheric pressure.

5. An apparatus according to claim 1 wherein said second delivery rate is within plus or minus 5 percent of said first delivery rate.

6. An apparatus according to claim 5 wherein said auger is a free flow auger.

7. A method for dispersing one or more solids into one or more liquids, said method comprising the steps of:

providing a hopper for containing said one or more solids, said hopper having a hopper inlet for receiving solids therein and a hopper outlet for distributing solids therefrom, providing a throat having a throat inlet in communication with said hopper outlet, a throat outlet and a vertically oriented rotatable auger disposed in said throat, said auger being rotatable at a plurality of rotational speeds, providing a mixer in communication with throat outlet, said mixer having an agitator for mixing together solids and liquids disposed in said mixer, providing a liquid supply line for supplying one or more liquids to said mixer, supplying a liquid to said mixer from said liquid supply line, creating a pressure in said mixer whereby said pressure in said mixer creates a differential pressure between said throat inlet and said throat outlet, rotating said auger to provide solids from said hopper to said mixer at a delivery rate whereby said solids and said liquid are disposed in contacting relationship with one another within said mixer, wherein said step of rotating said auger comprises rotating said auger at first, second and third auger rotational speeds to deliver solids to said mixer at a first, second and third delivery rates, respectively whereby said first, second and third delivery rates are linearly related with respect to said first, second and third auger rotational speeds.

8. A method according to claim 7 wherein said step of creating a pressure in said mixer comprises creating a subatmospheric pressure by rotational movement of said liquids in said mixer.

9. A method according to claim 8 wherein said step of supplying a liquid to said mixer comprises the step of supplying a liquid having a viscosity, said viscosity being at least 50,000 centipoises while said liquid is in said mixer.

10. A method according to claim 8 wherein said step of rotating said auger comprises rotating said auger at a first auger rotational speed to deliver solids to said mixer at a first delivery rate and rotating said auger at a second auger rotational speed to deliver solids to said mixer at a second delivery rate, said first delivery rate being controlled by said subatmospheric pressure, and said second delivery rate being controlled by said auger rotational speed.

11. A method according to claim 10 wherein said step of rotating said auger comprises rotating said auger at first, second and third auger rotational speeds to deliver solids to said mixer at a first, second and third delivery rates, respectively, said first delivery rate being substantially controlled by said subatmospheric pressure, said second delivery rate being controlled by a combination of said subatmospheric pressure and said auger rotational speed and said third delivery rate being substantially controlled by said auger rotational speed.

12. A method according to claim 7 further comprising the step of removing a mixture of solids and liquids from said mixer, said mixture of solids and liquids having a first solids concentration, said mixture having a second solids concentrations when said differential pressure is not present, said first solids concentration being at least 20 percent greater than said second solids concentration.

13. A method according to claim 7 wherein said solids and said liquid are supplied to said apparatus and mixed together in a continuous process.

* * * * *

UNITED STATES PATENT AND TRADEMARK OFFICE

CERTIFICATE OF CORRECTION

PATENT NO. : 6,712,496 B2
DATED : March 30, 2004
INVENTOR(S) : Kressin et al.

It is certified that error appears in the above-identified patent and that said Letters Patent is hereby corrected as shown below:

Column 6,
Line 7, delete "subatmoshpheric" and insert -- subatmospheric --.

Column 9,
Table 4, replace Table 4 with the following Table 4:

--

| Auger Speed (RPM) | Control Polyox Slope (kg*rpm/min) | Test Polyox Slope (kg*rpm/min) | Percent Difference In Slopes |
|---|---|---|---|
| 47 | | | |
| 132 | 0.006 | 0.004 | 33 |

--

Column 12,
Line 2, delete "a" between the words "of" and "vacuum."

Column 13,
Line 17, insert -- and -- between "(1.75 inches)" and "free flow."

Signed and Sealed this

Thirty-first Day of August, 2004

JON W. DUDAS
*Director of the United States Patent and Trademark Office*